US005521333A

United States Patent [19]

Kobayashi et al.

[11] Patent Number: 5,521,333

[45] Date of Patent: May 28, 1996

[54] FOUR-CORE BALANCED TRANSMISSION CABLE

[75] Inventors: Seie Kobayashi; Tetsuo Harada; Seiji Endo, all of Tochigi, Japan

[73] Assignee: Sumitomo Electric Industries, Ltd., Japan

[21] Appl. No.: 262,907

[22] Filed: Jun. 21, 1994

[30] Foreign Application Priority Data

Jun. 23, 1993 [JP] Japan ..... 5-151834

[51] Int. Cl.[6] ..... H01B 11/02

[52] U.S. Cl. ..... 174/113 R; 174/34; 174/36; 174/113 C; 174/110 PM; 174/110 F

[58] Field of Search ..... 174/113 R, 113 C, 174/131 A, 110 PM, 110 F, 34, 36

[56] References Cited

U.S. PATENT DOCUMENTS 2,871,151 1/1959 Lipton .
3,209,064 9/1965 Culter ..... 174/36
3,610,814 10/1971 Peacock ..... 174/113 R
4,084,065 4/1978 Swenson ..... 174/113 R

FOREIGN PATENT DOCUMENTS 937851 9/1963 United Kingdom ..... 174/36

*Primary Examiner*—Morris H. Nimmo
*Attorney, Agent, or Firm*—Cushman Darby & Cushman

[57] ABSTRACT

A four-core balanced transmission cable of the present invention includes four insulated electric wires, a low dielectric center interposition member having a diameter 0.35 to 0.45 times as great as an external diameter of the insulated electric wire, a pressing winding material for compressedly winding the four insulated electric wires and the center interposition member and a covering member for covering an external circumference of the pressing winding material. Accordingly, the four-core balanced transmission cable of the present invention is thin, soft and light so as to meet the standards or requirements for a cabling system of a computer.

4 Claims, 1 Drawing Sheet

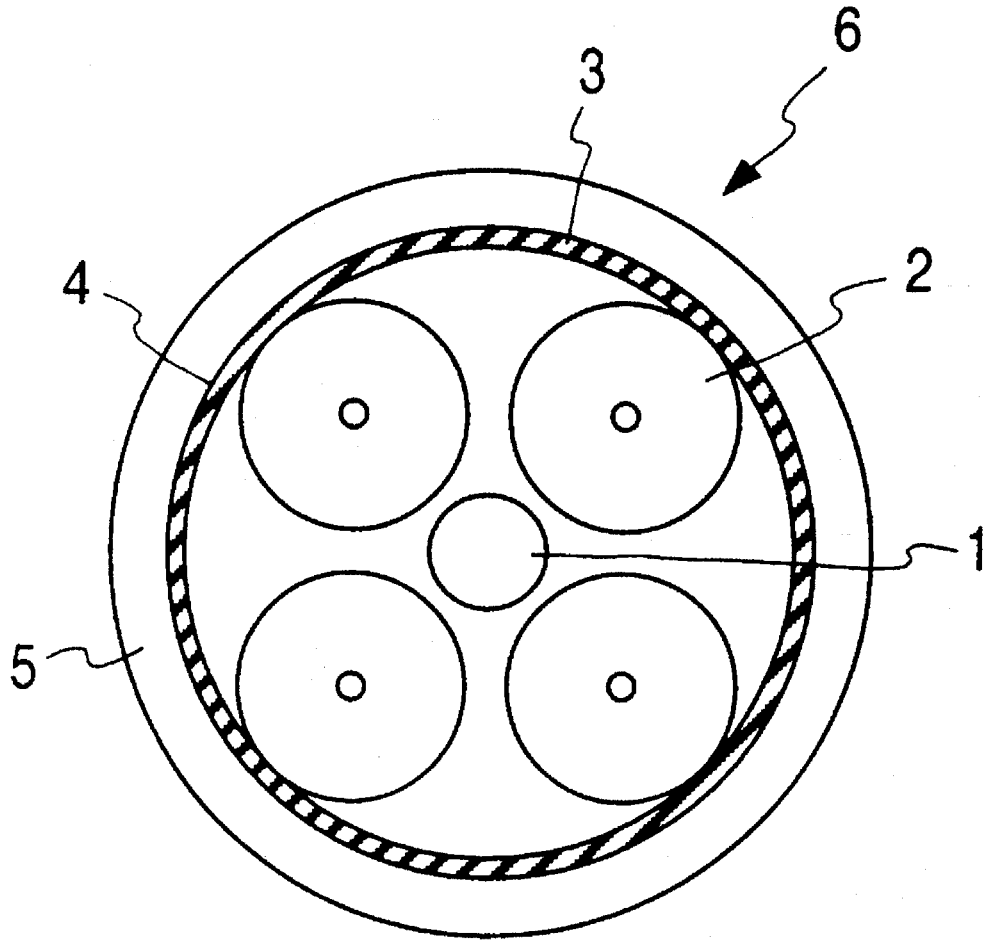
6
3
4
2
1
5

FOUR-CORE BALANCED TRANSMISSION CABLE

BACKGROUND OF THE INVENTION

1. Field of the Invention

The present invention relates to an improvement in a Quad-structure (quadruple structure) cable to be used in a cabling system of a computer.

2. Description of the Related Art

A conventional cable used in a cabling system of a computer has a disadvantage in that the cable is thick, hard and heavy because a pair-stranded structure is employed in the cable. Although it may be thought that this is an improved Quad-structure, the Quad-structure of the cable tends to get out of shape so that the quantity of near-end crosstalk increases, whereby the conventional cable is below the standards necessary for a cabling system of a computer.

As described above, the pair-stranded structure has a disadvantage in that the cable is thick, hard and heavy whereas the Quad structure as to performance is below the standards or requirements necessary for a cabling system of a computer.

SUMMARY OF THE INVENTION

It is an object of the present invention to provide a cable which is improved in these disadvantages so as to be thin, soft and light and so as to meet the standards or requirements for a cabling system of a computer.

A four-core balanced transmission cable of the present invention includes, four insulated electric wires, a center interposition having a diameter 0.35 to 0.45 times as great as an external diameter of the insulated electric wire, a pressing winding material for compressedly winding the four insulated electric wires and the center interposition, and a covering member for covering an external circumference of the pressing winding material.

The center interposition of a low dielectric constant material having a suitable size is disposed in the center of a Quad structure so that the Quad-structure can be prevented from getting out of shape. Accordingly, not only the quantity of near-end crosstalk can be reduced to be in a predetermined standard range but also the cable can be small in external diameter, soft and light.

BRIEF DESCRIPTION OF THE DRAWING

In the accompany drawing;

The FIGURE is a section view of a four-core balanced transmission cable according to the present invention.

DETAILED DESCRIPTION OF THE PREFERRED EMBODIMENT

The preferred embodiment of the present invention will be described referring with the accompany drawing as follows.

As shown in the FIGURE, a four-core balanced transmission cable 6 of the present invention includes, a high-density polyethylene string 1 as a center interposition, an insulated electric wire 2, a polyester tape 3, a tinned soft copper wire 4 and a 0.6 mm-thick PVC (Poly Vinyl Chloride) 5. The insulated electric wires 2 (external diameter: 1.45 mm) were prepared by coating 0.45 mm-diameter soft copper wires with 0.5 mm-thick foam polyethylene which is one of polyolefin as a covering material so as to have the foaming rate of about 60% and the dielectric constant of 1.54. The preferable covering material is polyethylene, or the like. Further, in case of using the polyethylene, its foaming rate is in the range of 55 to 65%, preferably, 57 to 63%, and its dielectric constant is in the range of 1.6 to 1.3. Four insulated electric wires 2 thus prepared were disposed around the high-density polyethylene string 1 having a diameter of 0.6 mm and a dielectric constant of 2.3 so that the string served as the center interposition. The diameter of the center interposition is preferably 0.35 to 0.45 times, as great as that of the insulated electric wires 2. The dielectric constant of the center interposition is in the range of 2.28 to 2.35. The preferable center interposition is polyolefin such as a poly ethylene, polypropylene or the like. The external circumference of the assembly was wound while pressed with the polyester tape 3 while pressed, and then braided with 0.12 mm tinned soft copper wire 4. Further, the external circumference was coated with 0.6 mm-thick PVC (Poly Vinyl Chloride) 5 to thereby prepare a 5.6 mm-external diameter cable for a cabling system of a computer.

As comparative examples, cables similar to the aforementioned cable were prepared by changing the size of the center interposition as shown in Table 1 or by changing the material of the center interposition in which the dielectric constant of respective interpositions are different from each other as shown in Table 2, respectively.

Results of measurement of the quantity of near-end crosstalk and results of measurement of impedance in the cables of the embodiment and comparative examples were as shown in Tables 1 and 2, respectively.

TABLE 1

RESULTS OF MEASUREMENT OF QUANTITY OF NEAR-END CROSSTALK

| | Thickness of high-density polyethylene center interposition (mm) | Ratio to external diameter of insulated cord | Quantity of near-end crosstalk [9.6 KHz–5 MHz] (dB) | Judgement by standards: less or more than −52 dB |
|---|---|---|---|---|
| Embodiment | 0.6 | 0.41 | −57.1 | pass |
| Comparative Example | Not provided | | −38.0 | not pass |
| | 0.3 | 0.20 | −42.7 | not pass |
| | 0.5 | 0.34 | −50.2 | not pass |
| | 0.8 | 0.55 | −45.5 | not pass |

TABLE 2

RESULTS OF MEASUREMENT OF IMPEDANCE

| | Dielectric constant of 0.6 mmϕ center interposition | Impedance [3 MHz–20 MHz] (Ω) | Judgement by standards: 150 ± 15 |
|---|---|---|---|
| Embodiment | 2.3 | 152 | pass |
| Comparative Example | 3.0 | 134 | not pass |
| | 3.5 | 120 | not pass |

The cable of the embodiment sufficiently satisfies the standards or requirements as a cable for a cabling system of a computer, that is, the quantity of near-end crosstalk of not larger than −52 dB and impedance of 150±15.0Ω. If the center interposition is too thin or thick and the structure has no center interposition, the quantity of near-end crosstalk is substandard. If the center interposition is not made of a low dielectric constant material such as polyolefin, the impedance is substandard. Only if a center interposition made of a low dielectric constant material having a suitable size is provided, a cable which satisfies the standards or requirements as a cable for a cabling system of a computer and which is small in external diameter, soft and light can be obtained with a Quad-structure.

What is claimed is:

1. A four-core balanced transmission cable comprising:

four insulated electric wires;

a low dielectric center interposition member having a diameter which is from 0.35 to 0.45 times as great as an external diameter of any one of said insulated electric wires, the dielectric constant of said center interposition member being from 2.28 to 2.35;

a pressing winding material compressively winding said four insulated electric wires and said center interposition member; and a covering member covering an external circumference of said pressing winding material.

2. A four-core balanced transmission cable according to claim 1, wherein said center interposition member is made of polyolefin.

3. A four-core balanced transmission cable a four-core balanced transmission cable comprising:

four insulated electric wires;

a low dielectric center interposition member having a diameter which is from 0.35 to 0.45 times as great as an external diameter of any one of said insulated electric wires;

a pressing winding material compressively winding said four insulated electric wires and said center interposition member; and a covering member covering an external circumference of said pressing winding material, each of said insulated electric wires including a central conductor and a coating material coating said central conductor, said coating material being made of polyolefin having a dielectric constant of from 1.3 to 1.6 and a foaming rate of from 55 to 60%.

4. A four-core balanced transmission cable according to claim 3, wherein the dielectric constant of said center interposition member is from 2.28 to 2.35.

* * * * *